US011365469B2

(12) United States Patent
Ishii et al.

(10) Patent No.: US 11,365,469 B2
(45) Date of Patent: Jun. 21, 2022

(54) HOT-DIP ALUMINIZED STEEL STRIP AND METHOD OF PRODUCING THE SAME

(71) Applicants: NIPPON STEEL NISSHIN CO., LTD., Tokyo (JP); NS WHEELING-NISSHIN, INC., Follansbee, WV (US)

(72) Inventors: Koutarou Ishii, Tokyo (JP); Shinya Furukawa, Tokyo (JP); Shinichi Koga, Tokyo (JP); Yasunori Hattori, Tokyo (JP); Tetsuhiko Okano, Follansbee, WV (US); Patrick Edward Pendleton, Follansbee, WV (US)

(73) Assignees: NIPPON STEEL NISSHIN CO., LTD., Tokyo (JP); NS Wheeling-Nisshin, Inc., Follansbee, WV (US)

( * ) Notice: Subject to any disclaimer, the term of this patent is extended or adjusted under 35 U.S.C. 154(b) by 0 days.

(21) Appl. No.: 16/499,982

(22) PCT Filed: Dec. 19, 2018

(86) PCT No.: PCT/JP2018/046815
§ 371 (c)(1),
(2) Date: Oct. 1, 2019

(87) PCT Pub. No.: WO2019/131385
PCT Pub. Date: Jul. 4, 2019

(65) Prior Publication Data

US 2020/0392614 A1 Dec. 17, 2020

Related U.S. Application Data

(60) Provisional application No. 62/610,400, filed on Dec. 26, 2017.

(30) Foreign Application Priority Data

Mar. 2, 2018 (JP) ..... JP2018-037949

(51) Int. Cl.
*C23C 2/12* (2006.01)
*C23C 2/40* (2006.01)

(52) U.S. Cl.
CPC . *C23C 2/12* (2013.01); *C23C 2/40* (2013.01)

(58) Field of Classification Search
CPC ..... C23C 2/12; C23C 2/40
See application file for complete search history.

(56) References Cited

U.S. PATENT DOCUMENTS

2002/0058154 A1 5/2002 Friedersdorf et al.
2002/0136920 A1 9/2002 McDevitt et al.
(Continued)

FOREIGN PATENT DOCUMENTS

AU 2014212962 A1 7/2015
CN 105063484 A 11/2015
(Continued)

OTHER PUBLICATIONS

International Preliminary Report on Patentability and Written Opinion for International Patent Application No. PCT/JP2018/046815, dated Jun. 30, 2020, 8 pages.
(Continued)

*Primary Examiner* — Hai Y Zhang
(74) *Attorney, Agent, or Firm* — Mintz Levin Cohn Ferris Glovsky and Popeo, P.C.; Katherine C. Jensen

(57) ABSTRACT

Provided is a hot-dip aluminized steel sheet with fine-sized spangles produced in a different way from conventional methods, and a method of producing a hot-dip aluminized steel sheet with fine-sized spangles in a different way from conventional methods. The hot-dip aluminized steel sheet includes: a substrate steel sheet; and an aluminum-based
(Continued)

coating which is formed by a hot-dip method on the surface of the substrate steel sheet and in which the average B concentration is not less than 0.005 mass % and the sum of the average Ti concentration and the average V concentration is not more than 0.03 mass %.

1 Claim, 3 Drawing Sheets

(56) References Cited

U.S. PATENT DOCUMENTS

| | | | | |
|---|---|---|---|---|
| 2003/0113575 | A1* | 6/2003 | McDevitt | C23C 2/265 428/653 |
| 2004/0161629 | A1 | 8/2004 | McDevitt | |
| 2005/0181229 | A1 | 8/2005 | McDevitt et al. | |
| 2007/0068682 | A1 | 3/2007 | McKinlay | |
| 2007/0181314 | A1 | 8/2007 | McKinlay | |
| 2017/0114436 | A1 | 4/2017 | Furukawa et al. | |
| 2018/0245175 | A1 | 8/2018 | Li et al. | |
| 2019/0078189 | A1 | 3/2019 | Furukawa et al. | |
| 2019/0368007 | A1 | 12/2019 | Tokuda et al. | |

FOREIGN PATENT DOCUMENTS

| | | | |
|---|---|---|---|
| EP | 3150739 | A1 | 4/2017 |
| JP | 2004-115908 | A | 4/2004 |
| JP | 2006-022409 | A | 1/2006 |
| JP | 3751879 | B2 | 3/2006 |
| JP | 2014-148715 | A | 8/2014 |
| JP | 5591414 | B1 | 9/2014 |
| JP | 6069558 | B1 | 2/2017 |
| JP | 6176424 | B1 | 8/2017 |
| WO | 01/27343 | A1 | 4/2001 |
| WO | 2017/154237 | A1 | 9/2017 |

OTHER PUBLICATIONS

International Search Report for International Application No. PCT/JP2018/046815, dated Mar. 7, 2019, 3 pages.

Japanese Office Action for Japanese Patent Application No. 2019-555051, dated Feb. 25, 2020, 11 pages with English translation.

* cited by examiner

HOT-DIP ALUMINIZED STEEL STRIP AND METHOD OF PRODUCING THE SAME

CROSS-REFERENCES TO RELATED APPLICATIONS

This application is a U.S. national phase application, pursuant to 35 U.S.C. § 371, of PCT/JP2018/046815, filed Dec. 19, 2018, designating the United States, which claims priority to Japanese Application No. 2018-037949, filed Mar. 2, 2018, and U.S. Provisional Application No. 62/610,400, filed Dec. 26, 2017. The entire contents of the aforementioned patent applications are incorporated herein by this reference.

TECHNICAL FIELD

The present invention relates to a hot-dip aluminized steel sheet and a method of producing the hot-dip aluminized steel sheet. More specifically, the present invention relates to (i) a hot-dip aluminized steel sheet which has spangles having a minute size and thus has a beautiful surface skin, and (ii) a method of producing such a hot-dip aluminized steel sheet.

BACKGROUND

A steel sheet hot-dip coated with an aluminum-based coating (hereinafter referred to as a "hot-dip aluminized steel sheet") is a coated steel sheet obtained by forming, on the surface of a steel sheet, a coating which contains aluminum as a main component, by a hot-dip method so that the steel sheet can have higher corrosion resistance and/or higher heat resistance. Such a hot-dip aluminized steel sheet has been widely used mainly for members that are required to have heat resistance, such as exhaust gas members of automobiles and members of combustion devices.

Note that the hot-dip aluminized steel sheet has a coating having a surface on which a spangle pattern appears, the spangle pattern being formed due to dendrites, which are structures obtained by solidification of aluminum (Al). The spangle pattern is a characteristic geometric pattern or a flower pattern, and each region (i.e., spangle) of the spangle pattern is constituted by dendrites.

A spangle grows during solidification of Al after coating. Growth of the spangle progresses as below. First, the nucleus of the spangle (i.e., spangle nucleus) occurs. Then, a primary dendrite arm grows from the spangle nucleus. Subsequently, a secondary dendrite arm develops from the primary dendrite arm. Growth of such dendrite arms stops due to a collision between adjacent spangles. It follows that presence of more spangle nuclei in the coating causes an increase in number of spangles. This causes each spangle to have a minute size.

The presence of such a spangle does not adversely affect a quality (e.g., corrosion resistance) of the hot-dip aluminized steel sheet. Note, however, that in the market, a hot-dip aluminized steel sheet is preferred which has spangles having a minute size and thus has a surface skin having an inconspicuous spangle pattern.

Under the circumstances, the following method is proposed, for example: a method of producing a hot-dip aluminized-galvanized steel sheet which includes a coating made of an aluminum-zinc alloy, the method involving, for the purpose of formation of fine spangles, adding titanium (Ti), zirconium (Zr), niobium (Nb), boron (B), a boride such as aluminum boride ($AlB_2$ or $AlB_{12}$), titanium carbide (TiC), titanium boride ($TiB_2$), and/or titanium aluminide ($TiAl_3$) to a coating bath so that more substances acting as spangle nuclei are obtained. Such a method is disclosed in, for example, Patent Literatures 1 to 3.

CITATION LIST

Patent Literature

Patent Literature 1

Japanese Patent Application Publication Tokukai No. 2004-115908 (Publication date: Apr. 15, 2004)

Patent Literature 2

Japanese Patent Application Publication Tokukai No. 2006-22409 (Publication date: Jan. 26, 2006)

Patent Literature 3

Japanese Patent No. 3751879 (Publication date: Dec. 16, 2005)

Patent Literature 4

Japanese Patent No. 5591414 (Publication date: Sep. 17, 2014)

Patent Literature 5

Japanese Patent No. 6069558 (Publication date: Feb. 1, 2017)

SUMMARY OF INVENTION

Technical Problem

Note, however, that use of the above method to produce a hot-dip aluminized steel sheet has the following problems.

Specifically, since aluminum (having a specific gravity of 2.7) is a relatively lightweight metal, an Al-based hot-dip coating bath containing molten aluminum as a main component is a little lower in specific gravity than an aluminum-zinc coating bath, which is a mixture of aluminum and zinc (having a specific gravity of 7.1). Thus, any of substances, such as Ti, Nb, titanium carbide (TiC), titanium boride ($TiB_2$), and titanium aluminide ($TiAl_3$), which are higher in specific gravity than the Al-based hot-dip coating bath, easily precipitates at the bottom of the Al-based hot-dip coating bath, so that it is difficult for such a substance to be uniformly dispersed in the Al-based hot-dip coating bath. This causes a problem of difficulty in stable formation of fine spangles on surfaces of hot-dip aluminized steel sheets which are continuously produced as in an industrial continuous operation.

Patent Literature 4 discloses a hot-dip aluminized steel sheet in which the B content of its coating is 0.002 mass % to 0.080 mass %. Note, however, that according to the technique disclosed in Patent Literature 4, B, which is unevenly distributed over a surface of the coating of the hot-dip aluminized steel sheet, allows the coating to be more slidable against a mold, and consequently allows the coating to be more resistant to galling. It follows that Patent Literature 4 fails to disclose that fine spangles are formed on the surface of a hot-dip aluminized steel sheet, and no special effect of reducing spangle size is obtained.

Patent Literature 5 discloses a technique to form fine spangles on the surface of a hot-dip aluminized steel sheet by controlling both the average B concentration and the average potassium (K) concentration of a coating to fall within predetermined ranges. According to this technique, it is possible to enhance the additive elements' spangle-size-reducing effect as compared to cases where B or K alone is added to the coating of the hot-dip aluminized steel sheet. However, with this technique, it is difficult to reduce spangle size any further.

In view of the circumstances, an object of one or more embodiments of the present invention is to provide a method of producing a hot-dip aluminized steel sheet with fine spangles in a different way from conventional methods, and a hot-dip aluminized steel sheet produced by this method.

Solution to Problem

The inventors have tried various methods to reduce spangle size of a hot-dip aluminized steel sheet, and made the following finding. On the basis of the following finding, the inventors arrived at the present invention.

Specifically, the inventors have noticed that, even when the amount of additive element(s) such as B added to an Al-based hot-dip coating bath, conditions of production (parameters) in coating equipment, and the like are kept constant, use of different coating lines sometimes results in hot-dip aluminized steel sheets with different spangle densities. That is, the spangle-size-reducing effect of the element(s) added to the Al-based hot-dip coating bath on the coating of the hot-dip aluminized steel sheet produced using the coating bath may differ depending on the coating line.

The inventors have conducted studies to find out why such a phenomenon occurs, and made the following findings: (i) the impurity concentration of an Al-based hot-dip coating bath differs from one coating line to another, and therefore the amount of an effective portion, which is effective in reducing spangle size, of the B contained in the coating bath also differs from one coating line to another; and (ii) the impurity concentration of the Al-based hot-dip coating bath is greatly influenced by the grade (purity) of an Al metal for use in initial make-up of the Al-based hot-dip coating bath.

The inventors have conducted diligent studies on the basis of these findings, and found that particularly the titanium (Ti) concentration and the vanadium (V) concentration of the Al-based hot-dip coating bath influence the spangle-size-reducing effect, and then found the ranges, which are appropriate to enhance the spangle-size-reducing effect provided by the addition of B, of proportions of components of the Al-based hot-dip coating bath and of the resulting Al-based coating. On the basis of these findings, the inventors have accomplished the present invention.

Specifically, a hot-dip aluminized steel sheet according to one or more embodiments of the present invention includes: a substrate steel sheet; and an aluminum-based coating which is formed by a hot-dip method on a surface of the substrate steel sheet and in which an average boron concentration is not less than 0.005 mass % and the sum of an average titanium concentration and an average vanadium concentration is not more than 0.03 mass %.

The hot-dip aluminized steel sheet according to one or more embodiments of the present invention may be arranged such that the number of spangle crystal nuclei on a surface of the aluminum-based coating per square centimeter of the surface of the aluminum-based coating is not less than 100.

A hot-dip aluminized steel sheet according to one or more embodiments of the present invention includes: a substrate steel sheet; and an aluminum-based coating formed by a hot-dip method on a surface of the substrate steel sheet, the hot-dip aluminized steel sheet satisfying the following condition (1):

$$[B] \geq 0.017 + 0.45 \times [Ti] + 0.42 \times [V] \quad (1)$$

where [B] represents an average boron concentration (in mass %) of the aluminum-based coating, [Ti] represents an average titanium concentration (in mass %) of the aluminum-based coating, and [V] represents an average vanadium concentration (in mass %) of the aluminum-based coating, wherein the number of spangle crystal nuclei on a surface of the aluminum-based coating per square centimeter of the surface of the aluminum-based coating is not less than 500.

A method of producing a hot-dip aluminized steel sheet according to one or more embodiments of the present invention includes: a coating bath preparing step including preparing an aluminum-based hot-dip coating bath containing aluminum as a main component such that a boron concentration of the aluminum-based hot-dip coating bath is not less than 0.005 mass % and the sum of an average titanium concentration and an average vanadium concentration of the aluminum-based hot-dip coating bath is not more than 0.03 mass %; and a coating step including dipping the substrate steel sheet in the aluminum-based hot-dip coating bath thus prepared and passing the substrate steel sheet through the aluminum-based hot-dip coating bath, the coating bath preparing step including preparing the aluminum-based hot-dip coating bath by (i) producing an aluminum bath liquid from a material which at least partially contains an aluminum metal with reduced amounts of titanium and vanadium and (ii) adding a boron source to the aluminum bath liquid.

A method of producing a hot-dip aluminized steel sheet according to one or more embodiments of the present invention includes: a coating bath preparing step including preparing an aluminum-based hot-dip coating bath containing aluminum as a main component such that the aluminum-based hot-dip coating bath satisfies the following condition (1):

$$[B] \geq 0.017 + 0.45 \times [Ti] + 0.42 \times [V] \quad (1)$$

where [B] represents a boron concentration (in mass %) of the aluminum-based hot-dip coating bath, [Ti] represents a titanium concentration (in mass %) of the aluminum-based hot-dip coating bath, and [V] represents a vanadium concentration (in mass %) of the aluminum-based hot-dip coating bath; and a coating step including dipping the substrate steel sheet in the aluminum-based hot-dip coating bath thus prepared and passing the substrate steel sheet through the aluminum-based hot-dip coating bath, the coating bath preparing step including adding a boron source to an aluminum bath liquid prepared from an aluminum metal such that a boron concentration of the aluminum bath liquid, based on a titanium concentration and a vanadium concentration of the aluminum bath liquid, at least satisfies the condition (1).

Advantageous Effects of Invention

According to one or more embodiments of the present invention, it is possible to provide a method of producing a hot-dip aluminized steel sheet with fine spangles in a different way from conventional methods, and a hot-dip aluminized steel sheet produced by this method.

BRIEF DESCRIPTION OF DRAWINGS

FIG. 1 is a cross-sectional view schematically illustrating a configuration of an aluminum pot, which is included in coating equipment for continuous production of a hot-dip aluminized steel sheet.

FIG. 2 is an optical photomicrograph of a state in which the outermost surface of the coating of the hot-dip aluminized steel sheet according to one or more embodiments of the present invention has been polished so that a dendrite structure is made observable.

FIG. 3 schematically illustrates one example of a method of preparing an Al-based hot-dip coating bath in one or more embodiments of the present invention.

DETAILED DESCRIPTION

Figure 1:
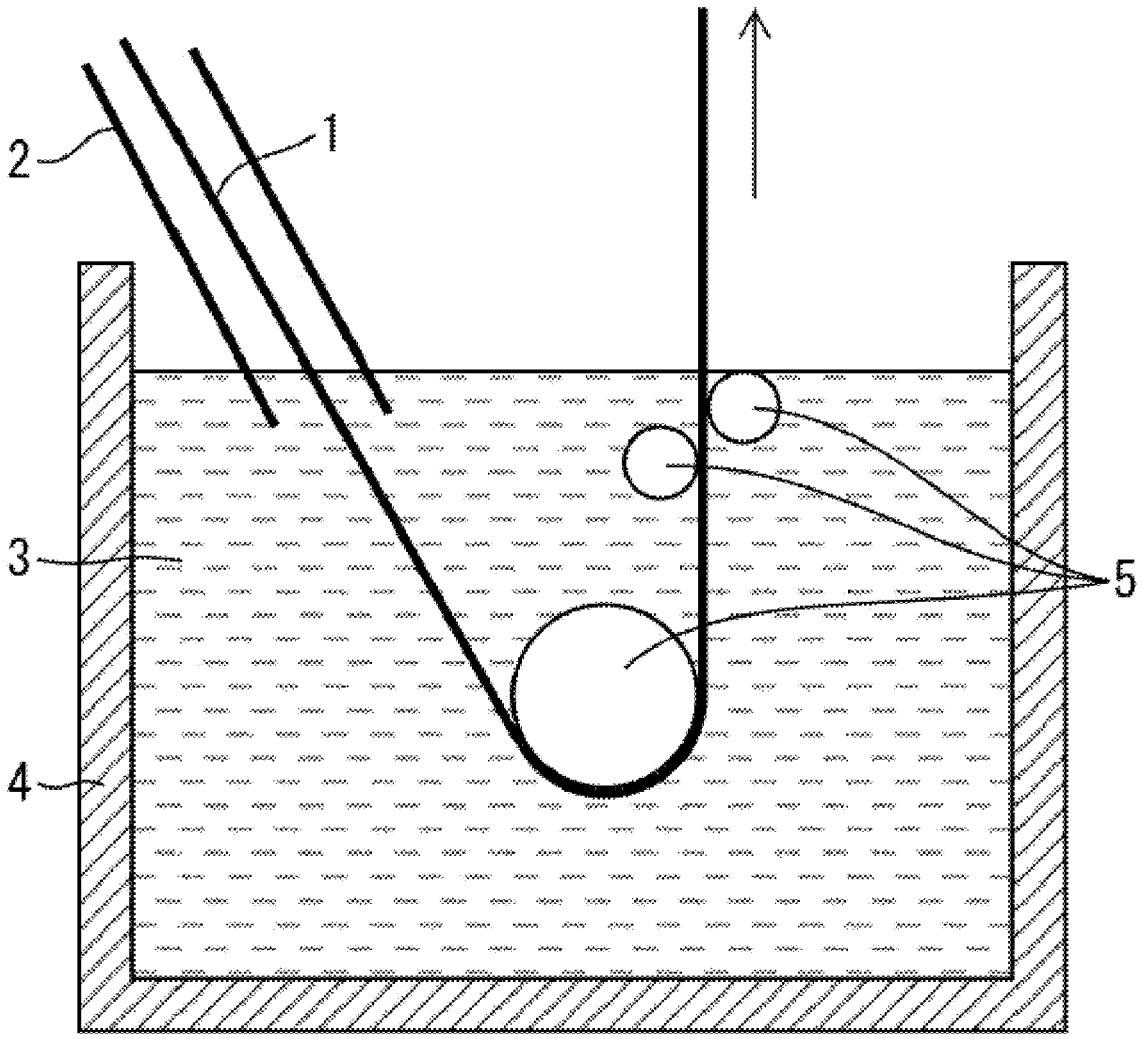
FIG. 1

The following description will discuss embodiments of the present invention in detail with reference to the drawings. Note that, unless otherwise specified, the present invention is not limited to the following description, which is provided so that subject matters of the present invention are better understood. Note also that an expression of a numeric range, such as "A to B", as used herein means "not less than A and not more than B", unless otherwise noted.

The following description will schematically discuss findings based on which the present invention was made, before discussing a hot-dip aluminized steel sheet and a method of producing such a hot-dip aluminized steel sheet in accordance with one or more embodiments of the present invention.

Schematic Description of Findings Based on which Present Invention was Made

As described earlier, a spangle pattern formed due to dendrites commonly appears on a surface of an Al-based coating of a hot-dip aluminized steel sheet. In order to produce a hot-dip aluminized steel sheet whose surface skin's spangle size is small and thus spangle patterns are inconspicuous, various approaches have been taken so far. One option is, for example, to carry out a surface fabrication on a hot-dip aluminized steel sheet as a post treatment, e.g., carry out skin-pass rolling many times after coating. However, such a method needs to be carried out with use of a large-scale apparatus or by a special process. This results in an increase in production cost.

In view of the above problem, a method has been proposed in which the spangle pattern is made inconspicuous by causing each spangle on the surface of the Al-based coating to have a minute size. In order to cause spangles to have a minute size, it is only necessary to cause spangle nuclei which are formed at an early stage of growth of the spangles to be highly dense. That is, the spangles can have a minute size by heterogeneous nucleation of spangle nuclei.

For example, known is a technique in which a substrate steel sheet is dipped in and taken out of a coating bath, and then fine mist or fine metal oxide powder is sprayed over a surface of an unsolidified coating. Note, however, that such a technique may (i) prevent, due to flapping of a steel sheet in a continuous hot-dip Al-coating line, spangles from being stably made finer and/or (ii) necessitate an apparatus for carrying out a spraying process and an apparatus for monitoring the spraying process.

In view of the above problems, as described earlier, a technique has been proposed in which a substance acting as spangle nuclei is added to a coating bath. According to this technique, fine spangles are obtained by dipping a substrate steel sheet in a coating bath whose components have been adjusted. Thus, this technique is low in cost and highly convenient. Note, however, that use of such a technique, which is usually used to produce a hot-dip aluminized-galvanized steel sheet, to produce a hot-dip aluminized steel sheet causes such problems as described earlier (precipitation at the bottom of the coating bath due to differences in specific gravity).

Under such circumstances, the inventors recently obtained a technique to produce a hot-dip aluminized steel sheet with fine spangles by adding a combination of B and K to the coating bath within certain ranges of concentration (see Patent Literature 5). Trial use of this technique for industrial production has resulted in the following phenomenon.

Specifically, when hot-dip aluminized steel sheets produced in two or more different locations equipped with production equipment for hot-dip aluminized steel sheets were compared with each other, the following was found. The hot-dip aluminized steel sheets produced in different locations (coating lines) sometimes differ from each other in spangle density even if the concentration of additive element(s) added to the coating bath, conditions for production in the equipment, and the like are kept constant. Therefore, when a hot-dip aluminized steel sheet is produced using a coating bath to which a combination of B and K falling within certain ranges of concentration has been added, the resulting hot-dip aluminized steel sheet does not always have a desired level of spangle density. Furthermore, hot-dip aluminized steel sheets are being required to have even smaller spangle size. The technique disclosed in Patent Literature 5 has room for improvement in these aspects.

The inventors have conducted various studies to find out what causes the instability of spangle density as described above.

The following description discusses a coating pot (aluminum pot) which is included in equipment for continuous production of a hot-dip aluminized steel sheet and in which an Al-based hot-dip coating bath is stored, with reference to FIG. 1. FIG. 1 is a cross-sectional view schematically illustrating a configuration of an aluminum pot 4, which is included in coating equipment for continuous production of a hot-dip aluminized steel sheet. Note that the coating equipment may have a general configuration (known configuration). For simple description, details of the coating equipment are not discussed here.

As illustrated in FIG. 1, a substrate steel sheet 1, which comes from annealing equipment (not illustrated), passes through a snout 2 in the form of a tube and is then dipped into an Al-based hot-dip coating bath 3 in a hermetically closed condition. The Al-based hot-dip coating bath 3 is stored in the aluminum pot 4. There are a plurality of sink rolls 5 within the Al-based hot-dip coating bath 3. The sink rolls 5 guide the substrate steel sheet 1 such that the substrate steel sheet 1 passes through the Al-based hot-dip coating bath 3.

The inventors produced hot-dip aluminized steel sheets using two or more kinds of such coating equipment, and then measured the concentrations of elements in those Al-based hot-dip coating baths 3. Specifically, aliquot portions were taken from each Al-based hot-dip coating bath 3. The portions were taken from two or more different positions (two or more different depths) in the aluminum pot 4. The concentrations of elements contained in each of the portions were determined by inductively coupled plasma-atomic emission spectroscopy (ICP-AES). As a result, it was found that, for example, the B concentration sometimes differ from one region to another in the Al-based hot-dip coating bath 3 within the aluminum pot 4, and the B concentration at the bottom of the Al-based hot-dip coating bath 3 is sometimes relatively high. Furthermore, the two or more kinds of coating equipment sometimes differ in impurity concentration of their Al-based hot-dip coating baths 3.

The inventors conducted further investigations to find out how the proportions of components (B concentration and impurity concentration) of the Al-based hot-dip coating bath 3 are related to the spangle density of the resulting hot-dip aluminized steel sheet. As a result, the inventors found that, among various impurities that are possibly contained in the Al-based hot-dip coating bath 3, particularly the Ti concentration and the V concentration significantly influence the spangle density of the resultant hot-dip aluminized steel sheet.

The Al-based hot-dip coating bath 3 is initially made up of an aluminum metal (Al metal). The Al metal used here can be, for example, an Al metal obtained via primary smelting (hereinafter may be referred to as a low-grade Al metal), which is obtained by smelting raw material (bauxite). Another Al metal that can also be used is, for example, an Al metal obtained via secondary smelting (hereinafter may be referred to as a high-purity Al metal), which is obtained by refining the Al metal obtained via primary smelting.

The low-grade Al metal contains various impurities at relatively high concentrations. In a case where the Al-based hot-dip coating bath 3 is initially made up of the low-grade Al metal, the Al-based hot-dip coating bath 3 can contain Ti and V which are derived from the low-grade Al metal. The inventors have found that such Ti and V, which are impurity components in the Al metal, can cause some issues.

The inventors have conducted studies on the basis of the above finding, and found that, when a hot-dip aluminized steel sheet is produced using an Al-based hot-dip coating bath 3 in which the B concentration is not less than 0.005 mass % and the sum of the Ti concentration and the V concentration is not more than 0.03 mass %, an excellent spangle-size-reducing effect is obtained regardless of whether K is added or not. This can be achieved by using the Al-based hot-dip coating bath 3 initially made up of a high-purity Al metal.

The inventors conducted further studies, and also found that, even if a low-grade Al metal is used, it is still possible to greatly reduce spangle size of the resulting hot-dip aluminized steel sheet, provided that the Al-based hot-dip coating bath 3 is adjusted to have a B concentration equal to or higher than a certain level based on the Ti concentration and V concentration of the Al-based hot-dip coating bath 3 (this will be described later in detail).

It is unknown why the above relationship between the Ti and V concentrations and the B concentration of the Al-based hot-dip coating bath 3 results in excellent spangle-size-reducing effect. Furthermore, in this case, it is not necessary to add a combination of B and K.

It is inferred that Ti and V in the Al-based hot-dip coating bath 3 react with B in the bath to form compounds such as $TiB_2$ and $VB_2$. In this case, the compounds such as $TiB_2$ and $VB_2$ precipitate at the bottom of the Al-based hot-dip coating bath 3, possibly resulting in a reduction in B concentration of the resulting coating. Furthermore, since the Al-based hot-dip coating bath 3 is stirred by the rotation of the sink rolls 5 and the passing of the substrate steel sheet 1, the resulting Al-based coating can contain the compounds such as $TiB_2$ and $VB_2$ in some amounts.

It is inferred that $TiB_2$ and $VB_2$ are inferior to B alone or aluminum boride in their ability to act as spangle crystal nuclei during the solidification of molten Al.

In either case, the higher the Ti and V concentrations of the Al-based hot-dip coating bath 3, the lower the spangle-size-reducing effect provided by B in the Al-based hot-dip coating bath 3 will be. This can be expressed as "the concentration of B that contributes to spangle size reduction (i.e., B that serves as spangle crystal nuclei) decreases". In the following descriptions, such a B concentration may be referred to as effective B concentration.

Embodiment 1

In Embodiment 1, a hot-dip aluminized steel sheet in accordance with one aspect of the present invention produced using a high-purity Al metal and a method of producing the hot-dip aluminized steel sheet are discussed.

Hot-Dip Aluminized Steel Sheet

Figure 2:
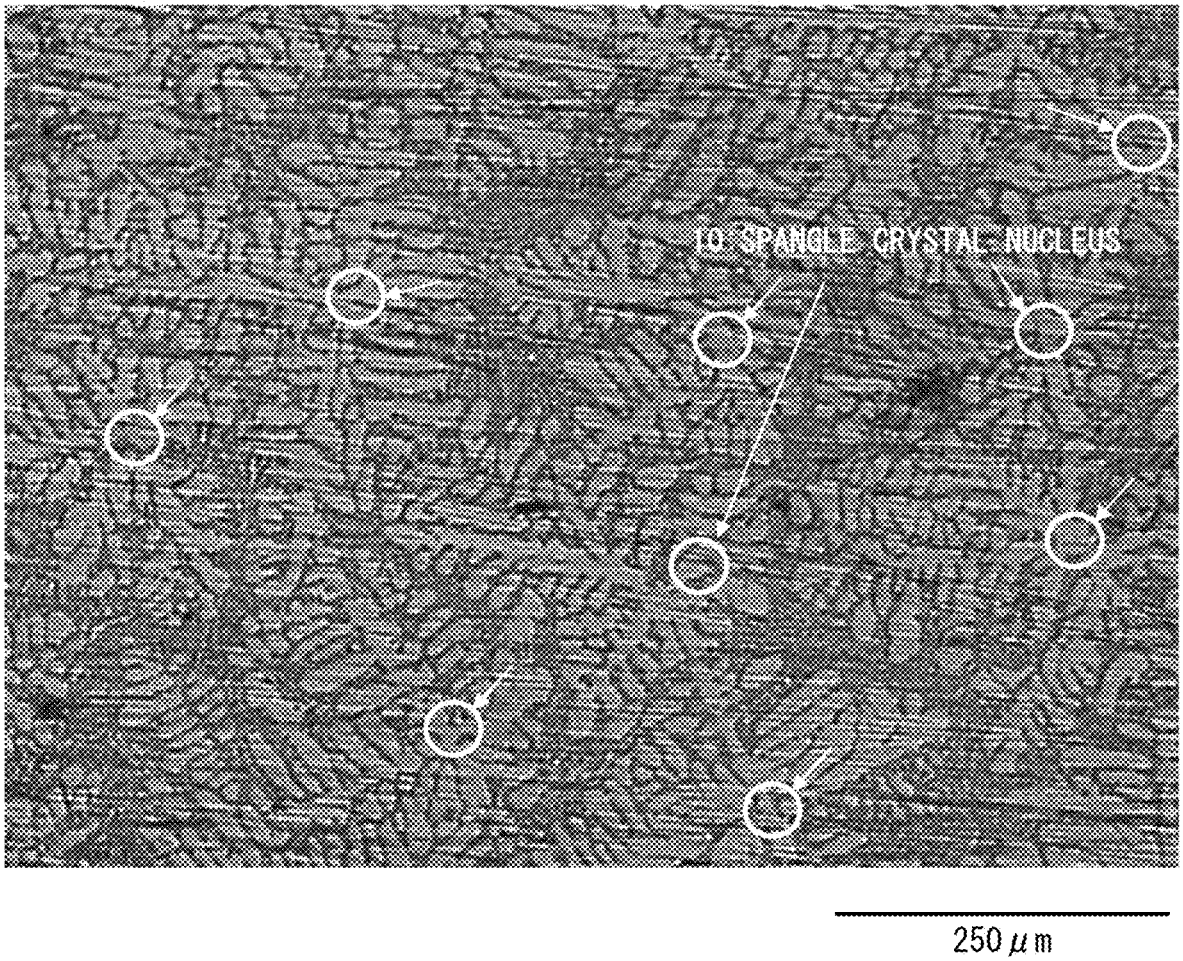
FIG. 2

The hot-dip aluminized steel sheet in accordance with Embodiment 1 will be discussed below with reference to FIG. 2. FIG. 2 is an optical photomicrograph of a state in which the outermost surface of the coating of the hot-dip aluminized steel sheet in accordance with Embodiment 1 has been polished so that a dendrite structure is made observable.

Schematically, the hot-dip aluminized steel sheet is produced by dipping and passing a substrate steel sheet in and through an Al-based hot-dip coating bath, which contains aluminum as a main component, so as to form an Al-based coating on a surface of the substrate steel sheet (see FIG. 1 mentioned earlier). On a surface of the Al-based coating, dendrites having grown from spangle crystal nuclei 10 are present (see FIG. 2). The density of the spangle crystal nuclei present on the surface of the Al-based coating will be discussed later.

Substrate Steel Sheet

The substrate steel sheet can be selected from various kinds of steel depending on the use thereof, including some kinds of steel conventionally used in substrates to be coated to form hot-dip aluminized steel sheets. For example, in the applications in which high corrosion resistance is considered important, a stainless steel may be employed. The thickness of the substrate steel sheet is not limited, and can be, for example, 0.4 mm to 3.2 mm. The term "substrate steel sheet (steel sheet)" as used herein is intended to include a substrate steel strip (steel strip).

Al—Fe-Based Alloy Layer

An Al—Fe-based alloy layer also forms between (at a boundary between) a steel base material of the substrate steel sheet and the Al-based coating because of interdiffusion between Al and Fe.

The Al—Fe-based alloy layer is made mainly of an Al—Fe-based intermetallic compound. Note here that the Al-based hot-dip coating bath preferably contains silicon (Si). An Al—Fe-based alloy layer formed by passing through an Si-containing Al-based hot-dip coating bath contains a large amount of Si. Both an Si-free Al—Fe-based alloy layer and a so-called Al—Fe—Si-based alloy layer containing Si are herein collectively referred to as an Al—Fe-based alloy layer. In a case where the Al—Fe-based alloy layer, which is made of a brittle intermetallic compound, has a greater thickness, the coating is made less adhesive. This leads to inhibition of press workability. From the viewpoint of press workability, the Al—Fe-based alloy layer preferably has a thickness that is as small as possible. However, a technique of achieving a too large reduction in thickness of the Al—Fe-based alloy layer increases the process load, and such a technique is uneconomical. Generally, the Al—Fe-based alloy layer only needs to have an average thickness of not less than 0.5 μm.

Composition of Al-Based Coating

The Al-based coating has a chemical composition that is substantially identical to the composition of the coating bath. The composition of the Al-based coating can thus be controlled by adjusting the composition of the coating bath.

The Al-based coating, which refers to a coating formed on the surface of the substrate steel sheet, encompasses the Al—Fe-based alloy layer. An aluminum oxide layer formed on the outermost surface of the hot-dip aluminized steel sheet causes no particular problem because the aluminum oxide layer is very thin. The aluminum oxide layer is therefore assumed to be encompassed in the Al-based coating. In a case where, for example, a film layer such as an organic film is further formed on the surface of the hot-dip aluminized steel sheet by a post treatment, such a film layer is, as a matter of course, not encompassed in the Al-based coating.

As such, the "average concentration" of a substance contained in the Al-based coating as used herein refers to an average of concentration distribution in the depth direction from the surface of the substrate steel sheet of the hot-dip aluminized steel sheet to the outer surface of the Al-based coating of the hot-dip aluminized steel sheet. Specifically, as described later, the average concentration is measured by carrying out concentration analysis with respect to a measurement solution in which the entire Al-based coating has been dissolved.

The concentrations of B, Ti, and V in the Al-based coating are each determined by averaging out the concentration distribution in the coating. Note here that B, Ti, and V in any form, e.g., compounds thereof, are included in the calculation of the concentration.

The Al-based coating of the hot-dip aluminized steel sheet in accordance with Embodiment 1 contains Al as a main component and contains at least B, and may optionally contain some other element.

Elements that can form a boride may reduce the effective B concentration and, in turn, may reduce the spangle-size-reducing effect. Therefore, it is preferable that the proportions of components of the Al-based coating are such that: Ti is 0 mass % to 0.02 mass %; V is 0 mass % to 0.02 mass %; Cr is 0 mass % to 0.2 mass %; Mn is 0 mass % to 0.01 mass %; and Zr is 0 mass % to 0.001 mass %.

In particular, the hot-dip aluminized steel sheet in accordance with Embodiment 1 is such that, because an Al-based hot-dip coating bath is initially made up of a high-purity Al metal, the sum of the Ti concentration and the V concentration of the Al-based coating is not more than 0.03 mass %. This increases the effective B concentration, resulting in a superior spangle-size-reducing effect.

It is more preferable that the sum of the Ti concentration and the V concentration is not more than 0.005 mass %. This enhances the spangle-size-reducing effect provided by B.

Si is an additive element that is effective for inhibition of growth of the Al—Fe-based alloy layer during solidification of molten Al. The Al-based hot-dip coating bath to which Si is added has a lower melting point. This is effective in reducing a temperature at which coating is carried out. In a case where the coating bath contains Si at a concentration of less than 1.0 mass %, the Al—Fe-based alloy layer is formed thick during hot-dip coating due to interdiffusion of Al and Fe. This causes peeling off in the coating during processing such as press forming. Meanwhile, in a case where the coating bath contains Si at a concentration of more than 12.0 mass %, the coating is cured. This makes it impossible to prevent cracking in a bent part of the coating and consequently causes the bent part to have lower corrosion resistance. Therefore, the coating bath preferably contains Si at a concentration of 1.0 mass % to 12.0 mass %. In particular, the coating bath which contains Si at a concentration of less than 3.0 mass % (i) allows an Si phase to be formed in a smaller amount during solidification of the coating and (ii) allows softening of a primary crystal Al phase. Such a coating bath is thus more effective in applications in which bending workability is considered important.

Furthermore, Fe, which comes from the substrate steel sheet and/or a constituent member(s) of a coating pot, is mixed into the Al-based hot-dip coating bath. Therefore, generally, the Al-based coating contains Fe at a concentration of not less than 0.05 mass %. Note that Fe is permitted to be contained in the Al-based coating at a concentration of up to 3.0 mass %, but more preferably not more than 2.5 mass %.

The hot-dip aluminized steel sheet may contain K. The K content of the coating bath is preferably not more than 0.02 mass %. If the K content of the coating is more than 0.02 mass %, the hot-dip aluminized steel sheet may become less resistant to corrosion.

Besides the above elements, an element(s) (such as strontium (Sr), sodium (Na), calcium (Ca), antimony (Sb), phosphorus (P), and/or magnesium (Mg) may be intentionally added to the Al-based hot-dip coating bath as necessary, or the above element(s) coming from, for example, a raw material may be mixed in the Al-based hot-dip coating bath. The hot-dip aluminized steel sheet in accordance with Embodiment 1 can also contain such an element that has been conventionally generally accepted. Specifically, for example, a hot-dip aluminized steel sheet can contain Sr at a concentration falling within the range of 0 mass % to 0.2 mass %, Na at a concentration falling within the range of 0 mass % to 0.1 mass %, Ca at a concentration falling within the range of 0 mass % to 0.1 mass %, Sb at a concentration falling within the range of 0 mass % to 0.6 mass %, P at a concentration falling within the range of 0 mass % to 0.2 mass %, and/or Mg at a concentration falling within the range of 0 mass % to 5.0 mass %.

The balance of the Al-based hot-dip coating bath can be constituted by Al and unavoidable impurities.

Advantages

As described above, a hot-dip aluminized steel sheet in accordance with Embodiment 1 includes: a substrate steel sheet; and an Al-based coating which is formed by a hot-dip method on a surface of the substrate steel sheet and in which the average B concentration is not less than 0.005 mass % and the sum of the average Ti concentration and the average V concentration is not more than 0.03 mass %.

In a case where the Al-based coating contains B at a concentration falling within the above range and contains Ti and V at a concentration falling within the above range, it is possible to achieve an Al-based coating in which the number of spangle crystal nuclei on a surface of the Al-based coating per square centimeter of the surface of the Al-based coating is not less than 100. This makes it possible to produce a hot-dip aluminized steel sheet which includes a coating having a surface on which fine spangles are sufficiently formed and which thus has a beautiful surface appearance.

By referring to FIG. 2 again, the following description will discuss the density of spangle crystal nuclei. As illustrated in FIG. 2, the spangles are non-uniform and irregular in size. However, spangle crystal nuclei 10 are still distinguishable when viewed through, for example, an optical microscope.

Therefore, by counting the number of spangle crystal nuclei 10 present in a certain visual field area, the number of spangle crystal nuclei 10 per area of that size can be found. From the number of spangle crystal nuclei 10 per visual field area, it is possible to roughly calculate the number of spangle crystal nuclei 10 present per square centimeter surface area of the Al-based coating. Note that such a counting method as described above is merely an example, and the number of spangle crystal nuclei can be counted by any other method.

Furthermore, the hot-dip aluminized steel sheet is obtained by a method that does not necessitate addition of a combination of B and K to the coating, and thus is obtained in a way different from conventional methods. In addition, by adjusting the B concentration of the Al-based hot-dip coating bath, it is possible to adjust the effective B concentration. It follows that the spangle density of the hot-dip aluminized steel sheet, which is obtained by passing through the coating bath, tends to change according to the B concentration of the coating bath. Thus, according to the hot-dip aluminized steel sheet in accordance with Embodiment 1, it is easy to control the spangle density of the hot-dip aluminized steel sheet.

The Al-based coating in which the average B concentration is less than 0.005 mass % makes it impossible to achieve a satisfactory spangle-size-reducing effect. Furthermore, even if the average B concentration of the Al-based coating of Embodiment 1 is not less than 0.005 mass %, the Al-based coating may not be able to achieve a satisfactory spangle-size-reducing effect if the sum of the average Ti concentration and the average V concentration is more than 0.03 mass %.

On the other hand, the Al-based coating in which the average B concentration is more than 0.50 mass % causes the spangle-size-reducing effect to reach a saturation, and no superiority is displayed even if the average B concentration is further increased. Furthermore, the Al-based coating in which the average B concentration is more than 3.0 mass % may cause a decrease in corrosion resistance.

As such, in order to ensure the corrosion resistance of the hot-dip aluminized steel sheet, the hot-dip aluminized steel sheet is preferably arranged such that the average B concentration of the Al-based coating is 0.005 mass % to 3.0 mass %, the average K concentration of the Al-based coating is not more than 0.02 mass %, and the sum of the average Ti concentration and the average V concentration of the Al-based coating is not more than 0.03 mass %. This makes it possible to obtain a hot-dip aluminized steel sheet with a beautiful surface appearance and high corrosion resistance.

As described earlier, the spangle-size-reducing effect reaches the saturation in a case where the average B concentration of the Al-based coating is increased to some extent. Therefore, in regard to the hot-dip aluminized steel sheet of Embodiment 1, the upper limit of the average B concentration does not necessarily have to be defined.

The hot-dip aluminized steel sheet in accordance with Embodiment 1 is preferably arranged such that the average B concentration of the Al-based coating is not less than 0.03 mass %. With this arrangement, it is possible to achieve an Al-based coating in which the number of spangle crystal nuclei per square centimeter of the surface of the Al-based coating is not less than 500. This makes it possible to produce a hot-dip aluminized steel sheet which has a more beautiful surface appearance.

The Al-based coating of the hot-dip aluminized steel sheet does not necessarily need to be provided on both sides of the substrate steel sheet, and only needs to be provided on at least one side of the substrate steel sheet.

Method of Producing Hot-Dip Aluminized Steel Sheet

Figure 3:
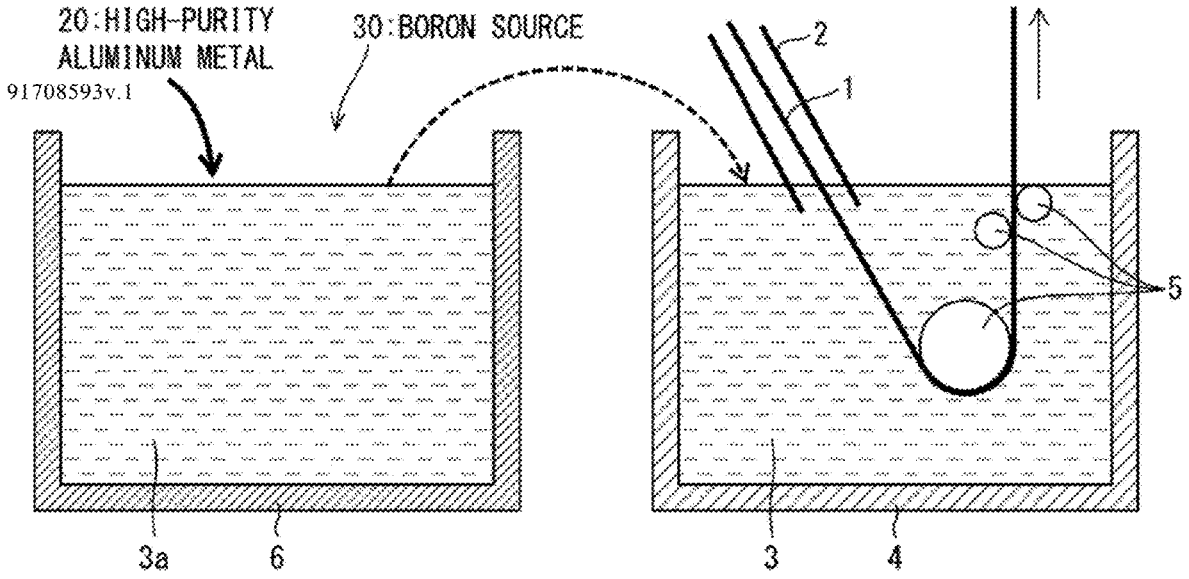
FIG. 3

The following description will discuss a method of producing a hot-dip aluminized steel sheet in accordance with Embodiment 1, with reference to FIG. 3. FIG. 3 schematically illustrates one example of a method of preparing an Al-based hot-dip coating bath in accordance with Embodiment 1.

A hot-dip aluminized steel sheet in accordance with Embodiment 1 can be produced by a hot-dip coating method with use of a coating bath containing B, Ti, and V at respective adjusted concentrations. For example, the hot-dip aluminized steel sheet can be produced in an experimental line and by a common continuous Al-coating production process (production apparatus). Alternatively, the hot-dip aluminized steel sheet according to one or more embodiments of the present invention can be produced by applying the present invention to any method, known to a skilled person, of producing a hot-dip aluminized steel sheet.

A method of producing a hot-dip aluminized steel sheet in accordance with Embodiment 1 includes a coating bath preparing step including preparing an Al-based hot-dip coating bath containing aluminum as a main component such that the B concentration of the Al-based hot-dip coating bath is not less than 0.005 mass % and the sum of the average Ti concentration and the average V concentration of the Al-based hot-dip coating bath is not more than 0.03 mass %; and a coating step including dipping the substrate steel sheet in the Al-based hot-dip coating bath thus prepared and passing the substrate steel sheet through the Al-based hot-dip coating bath.

The average concentration of each component contained in the Al-based coating formed through the coating step is substantially identical to the composition of the Al-based hot-dip coating bath (i.e., the concentration of each component contained in the Al-based hot-dip coating bath). The configuration makes it possible to produce a hot-dip aluminized steel sheet including an Al-based coating in which the average B concentration is not less than 0.005 mass % and the sum of the average Ti concentration and the average V concentration is not more than 0.03 mass %.

Coating Bath Preparing Step

Generally, coating equipment for continuous production of a hot-dip aluminized steel sheet sometimes includes a pre-melting pot 6 near an aluminum pot 4 (see FIG. 1). An aluminum ingot(s) and additive substances are allowed to melt in the pre-melting pot 6, and thereby a composition-adjusted coating bath 3*a* for supply to the aluminum pot 4 is prepared. Note that other specific configurations of the coating equipment other than those described below are not particularly limited, and the illustrations and descriptions therefor are omitted here.

As illustrated in the left half of FIG. 3, in the coating bath preparing step, a high-purity Al metal 20 is first allowed to melt in the pre-melting pot 6 to form an aluminum bath liquid (molten Al). The high-purity Al metal 20 is, for example, a commercially-available Al metal produced by refining a low-grade Al metal obtained via primary smelting. The high-purity Al metal 20 is lower in Ti content and V content than the low-grade Al metal. The sum of the Ti content and the V content of the high-purity Al metal 20 is, for example, not more than 0.02 mass %.

Next, a B source 30 is added to the molten Al in the pre-melting pot 6. The B source 30 may be, for example, an aluminum master alloy containing B (Al—B metal). Alternatively, the B source 30 may be B alone or a boride such as aluminum boride (e.g., $AlB_2$ or $AlBi_2$). The B source 30 is not limited to a particular substance or form, provided that the B source 30 is capable of adjusting the B concentration of the molten Al.

Some other element may also be added to the molten Al in the pre-melting pot 6 depending on need. For example, addition of an aluminum master alloy containing Si (Al—Si metal) makes it possible to adjust the Si concentration. Also in regard to other elements, addition of an aluminum master alloy containing a certain element or use of some other known method makes it possible to adjust the concentration of that element.

The composition-adjusted coating bath 3*a*, adjusted to a desired composition, is produced in the above manner.

Next, as illustrated in the right half of FIG. 3, the composition-adjusted coating bath 3*a* is transferred into the aluminum pot 4, thereby making an Al-based hot-dip coating bath 3 whose B, Ti, and V concentrations fall within the ranges defined in the present invention. The concentrations of components other than B, Ti, and V in the Al-based hot-dip coating bath 3 may be various concentrations and thus the Al-based hot-dip coating bath 3 may be, for example, an Al-9% Si bath or a pure Al bath.

In a case where the Al-based hot-dip coating bath 3 is an Al-9% Si bath, an Al-9% Si metal may be used as the high-purity Al metal 20 in the coating bath preparing step.

Alternatively, the Al-based hot-dip coating bath 3, whose B, Ti, and V concentrations fall within the ranges defined in the present invention, may be made by adjusting the composition of the coating bath within the aluminum pot 4 without using the pre-melting pot 6. Alternatively, the composition-adjusted coating bath 3*a* prepared with the use of the pre-melting pot 6 may be cooled to solid form (ingot) and then the ingot may be transferred into the aluminum pot 4.

The amount of the high-purity Al metal 20 used is not particularly limited, provided that the Al bath liquid is produced from a material at least partially containing the high-purity Al metal 20 and that the composition of the Al-based hot-dip coating bath 3 is controlled such that the sum of the Ti concentration and the V concentration of the Al-based hot-dip coating bath 3 is not more than 0.03 mass %.

The composition of the Al-based hot-dip coating bath 3 is determined, for example, in the following manner. The Al-based hot-dip coating bath 3, to which some kinds of substance have been added in amounts calculated to achieve desired concentrations, is heated and retained. Then, the Al-based hot-dip coating bath 3 is stirred, and an aliquot is taken from the Al-based hot-dip coating bath 3 and used as a test sample. The test sample is analyzed for its components, and the obtained result is used as the composition of the Al-based hot-dip coating bath 3.

Coating Step

In the coating step, as illustrated in the right half of FIG. 3, a substrate steel sheet 1 is dipped in and passed through the Al-based hot-dip coating bath 3. Then, a general post treatment (not illustrated) is carried out. This makes it possible to continuously produce a hot-dip aluminized steel sheet having fine spangles stably formed on the surface of its coating.

Note that, in the coating step, the continuous passing of the substrate steel sheet 1 through the Al-based hot-dip coating bath 3 causes stirring of the Al-based hot-dip coating bath 3. This prevents the compounds such as $TiB_2$ and $VB_2$, which form within the Al-based hot-dip coating bath 3, from completely settling at the bottom of the Al-based hot-dip coating bath 3, and instead the compounds are possibly partially contained in the resulting Al-based coating. In this case, the average Ti concentration and the average V concentration of the Al-based coating may be lower than, but not higher than, those of the Al-based hot-dip coating bath 3. As such, by employing an arrangement in which the sum of the Ti concentration and the V concentration of the Al-based hot-dip coating bath 3 is not more than 0.03 mass %, it is possible to obtain an Al-based coating in which the sum of the average Ti concentration and the average V concentration is lower than that of the Al-based hot-dip coating bath 3.

EXAMPLE 1

The Following is an Example of Embodiment 1.

Hot-dip aluminized steel sheets (test samples) were produced as below in an experimental line with use of coating experimental equipment by using, as a substrate steel sheet, a cold-rolled annealed steel sheet having a thickness of 0.8 mm and having the chemical composition shown in Table 1. Specifically, each hot-dip aluminized steel sheet was produced by (i) dipping the substrate steel sheet in an Al-based hot-dip coating bath prepared as described later, (ii) taking out the substrate steel sheet thus dipped, and (iii) solidifying a coating at a given cooling rate. The conditions in which the hot-dip aluminized steel sheets were produced are shown in Table 2.

TABLE 1

| Chemical composition (mass %) | | | | | | | |
|---|---|---|---|---|---|---|---|
| C | Si | Mn | P | S | Al | O | N |
| 0.033 | <0.01 | 0.23 | <0.01 | 0.013 | 0.01 | 0.0027 | 0.0025 |

TABLE 2

| | |
|---|---|
| Temperature of coating bath | 650° C. |
| Duration of dipping in coating bath | 2 sec. |
| Cooling rate | 11° C./s |
| Amount of coating attached to one side | about 80 g/m$^2$ |

The components of each coating bath were adjusted in the following manner with the use of aluminum metals A to F shown in Table 3. Molten Al was prepared mainly from aluminum metal A (high-purity Al metal) and aluminum metal B (Al-9% Si metal). The Si concentration was adjusted with the use of aluminum metal C (Al-20% Si metal), and the boron concentration was adjusted with the use of aluminum metal D (Al-4% B (boron) metal). The Ti concentration was adjusted with the use of aluminum metal E (Al-5% Ti metal), and the V concentration was adjusted with the use of aluminum metal F (Al-5% V metal). The Fe concentration was adjusted with the use of a cold-rolled steel sheet which is the same as the substrate steel sheet.

TABLE 3

(mass %)

| Base metal | B | Si | K | Ti | V | Cr | Mn | Fe | Zr | Al |
|---|---|---|---|---|---|---|---|---|---|---|
| Aluminum metal A | <0.001 | 0.040 | <0.001 | 0.003 | 0.005 | <0.001 | 0.001 | 0.12 | <0.001 | bal. |
| Aluminum metal B | <0.001 | 9.2 | <0.001 | 0.001 | 0.002 | <0.001 | 0.003 | 0.14 | <0.001 | bal. |
| Aluminum metal C | <0.001 | 20.1 | <0.001 | 0.002 | 0.001 | <0.001 | 0.004 | 0.13 | <0.001 | bal. |
| Aluminum metal D | 4.2 | 0.13 | 0.19 | 0.12 | 0.006 | <0.001 | 0.001 | 0.14 | 0.001 | bal. |
| Aluminum metal E | <0.001 | 0.071 | 0.2 | 4.8 | 0.011 | 0.002 | 0.003 | 0.19 | <0.001 | bal. |
| Aluminum metal F | <0.001 | 0.12 | 0.11 | 0.01 | 4.9 | 0.003 | 0.003 | 0.16 | <0.001 | bal. |

Each coating bath was adjusted to an Si concentration of 0 mass % to 15 mass %, an Fe concentration of 2.0 mass %, a B concentration of 0 mass % to 0.5 mass %, a Ti concentration of 0.0001 mass % to 0.1 mass %, and a V concentration of 0.0002 mass % to 0.1 mass %, with the use of various proportions of aluminum metals A to F. Note that K is mixed in the coating bath because of the aluminum metals D to F.

The obtained hot-dip aluminized steel sheets were subjected to the following analyses.

ICP Analysis on Components in Coating

The amounts of components in a coating bath can be determined by determining the amounts of components in a coating. First, the coating was dissolved in the following manner.

Test samples produced with use of the foregoing Al-based hot-dip coating baths having various compositions were each cut into a piece having a given size, so that a test sample piece was prepared. The test sample piece was put into an NaOH solution (10 ml) at a concentration of 25%, was left to stand still, and then was heated so that the coating was completely dissolved in the solution. After it was confirmed that the coating had been completely dissolved, the test sample piece, from which the coating had been removed by being dissolved, was taken out of the solution. Subsequently, the solution was further heated so that the liquid would evaporate to dryness. A product obtained as a result of evaporation to dryness was dissolved in a mixed acid (a mixed solution of 40 ml of nitric acid and 10 ml of hydrochloric acid) while being heated, and ultrapure water was added to a resultant solution so that the volume of the solution was adjusted to a precise volume of 250 ml. The solution which had been obtained from the test sample piece and whose volume had been thus adjusted was used as a solution for use in measurement of the composition of each test sample.

Thereafter, the solution for use in measurement of the composition of each test sample was subjected to the following two types of quantitative analyses so that the composition of the coating was found.

The quantitative analysis of Si, B, Ti, and V was carried out by an inductively coupled plasma atomic emission spectrometry method (ICP-AES method). The quantitative analysis of K was carried out by an inductively coupled plasma mass spectrometry method (ICP-MS method).

Number of Spangle Crystal Nuclei on Surface of Coating

A dendrite structure was made observable by buffing the surface of each test sample so as to make smoother the outermost surface layer extending from the surface of the coating to the depth of 5 μm. Then, the number of spangle crystal nuclei present per square centimeter of the surface of the coating was calculated with use of an optical microscope. The surface appearance was evaluated based on the following criteria, and the surface appearance evaluated as "Excellent" or "Good" was regarded as acceptable.

Excellent: Not less than 500 spangle crystal nuclei were present per square centimeter of the surface of the coating.

Good: Not less than 100 and less than 500 spangle crystal nuclei were present per square centimeter of the surface of the coating.

Poor: Not less than 50 and less than 100 spangle crystal nuclei were present per square centimeter of the surface of the coating.

Very Poor: Less than 50 spangle crystal nuclei were present per square centimeter of the surface of the coating.

Corrosion Resistance of Coating

An untreated Al-based coating of each test sample was subjected to a neutral salt spray test (NSS test), specified by JIS Z2371:2000, and thereby the percentage of white rusted area was determined. Corrosion resistance of the coating was evaluated based on the following criteria, and the coating evaluated as "Good" was regarded as acceptable.

Good: The percentage of white rusted area was not less than 0% and less than 5%.

Poor: The percentage of white rusted area was not less than 5%.

The results are shown in Table 4.

TABLE 4

| Sample type | No. | Amount of each element in coating (mass %) Si | B | K | Ti | V | Ti + V | Spangle density (number of spangle crystal nuclei per cm$^2$) | Surface appearance | Corrosion resistance |
|---|---|---|---|---|---|---|---|---|---|---|
| Samples of Example of the present invention | 1 | 8.8 | 0.005 | <0.0001* | 0.001 | 0.002 | 0.003 | 120 | Good | Good |
| | 2 | 0.0 | 0.010 | 0.0004 | 0.001 | 0.010 | 0.011 | 120 | Good | Good |
| | 3 | 8.7 | 0.008 | 0.0008 | 0.008 | 0.001 | 0.009 | 100 | Good | Good |
| | 4 | 0.0 | 0.009 | <0.0001* | 0.001 | 0.002 | 0.003 | 200 | Good | Good |
| | 5 | 2.0 | 0.015 | 0.0004 | 0.005 | 0.002 | 0.007 | 400 | Good | Good |
| | 6 | 9.0 | 0.017 | 0.0020 | 0.002 | 0.001 | 0.003 | 600 | Excellent | Good |
| | 7 | 2.2 | 0.018 | 0.0010 | 0.005 | 0.005 | 0.010 | 450 | Good | Good |
| | 8 | 0.5 | 0.020 | 0.0005 | 0.006 | 0.002 | 0.008 | 400 | Good | Good |
| | 9 | 5.0 | 0.020 | 0.0008 | 0.020 | 0.001 | 0.021 | 300 | Good | Good |
| | 10 | 9.1 | 0.021 | 0.0001 | 0.006 | 0.014 | 0.020 | 400 | Good | Good |
| | 11 | 9.0 | 0.022 | 0.0350 | 0.001 | 0.001 | 0.002 | 900 | Excellent | Poor |
| | 12 | 2.5 | 0.022 | <0.0001* | 0.001 | 0.003 | 0.004 | 800 | Excellent | Good |
| | 13 | 9.2 | 0.023 | 0.0015 | 0.016 | 0.012 | 0.028 | 400 | Good | Good |
| | 14 | 9.2 | 0.026 | 0.0003 | 0.001 | 0.002 | 0.003 | 1100 | Excellent | Good |
| | 15 | 13.6 | 0.031 | 0.0200 | 0.001 | 0.021 | 0.022 | 700 | Excellent | Good |
| | 16 | 9.2 | 0.032 | 0.0500 | 0.010 | 0.015 | 0.025 | 1000 | Excellent | Poor |
| | 17 | 9.2 | 0.034 | 0.0020 | 0.006 | 0.019 | 0.025 | 1500 | Excellent | Good |
| | 18 | 9.0 | 0.041 | 0.0001 | 0.003 | 0.002 | 0.005 | 1800 | Excellent | Good |
| Samples of comparative examples | 19 | 0.5 | <0.001* | <0.0001* | 0.0010 | 0.002 | 0.003 | 5 | Very Poor | Good |
| | 20 | 12.0 | <0.001* | <0.0001* | 0.100 | 0.050 | 0.150 | 5 | Very Poor | Good |
| | 21 | 5.1 | 0.002 | 0.0004 | 0.001 | 0.002 | 0.003 | 5 | Very Poor | Good |
| | 22 | 9.2 | 0.002 | 0.0001 | 0.050 | 0.060 | 0.110 | 5 | Very Poor | Good |
| | 23 | 9.5 | 0.010 | 0.0005 | 0.020 | 0.014 | 0.034 | 80 | Poor | Goad |
| | 24 | 9.5 | 0.015 | 0.0001 | 0.015 | 0.023 | 0.038 | 70 | Poor | Good |
| | 25 | 8.8 | 0.017 | 0.0001 | 0.030 | 0.050 | 0.080 | 60 | Poor | Good |
| | 26 | 8.7 | 0.020 | 0.0003 | 0.050 | 0.006 | 0.056 | 80 | Poor | Good |
| | 27 | 9.0 | 0.022 | <0.0001* | 0.022 | 0.016 | 0.038 | 50 | Poor | Good |
| | 28 | 9.0 | 0.022 | 0.0008 | 0.020 | 0.050 | 0.070 | 50 | Poor | Good |
| | 29 | 8.9 | 0.028 | 0.0012 | 0.021 | 0.015 | 0.036 | 60 | Poor | Good |
| | 30 | 12.1 | 0.051 | 0.0200 | 0.050 | 0.200 | 0.250 | 80 | Poor | Good |

*B is not greater than the detectable limit by ICP-AES, K is not greater than the detectable limit by ICP-MS.

As is clear from Samples No. 1 to No. 18 of Example of the present invention shown in Table 4, in the samples in each of which the proportions of components of the coating fall within the ranges defined in the present invention, the number of spangle crystal nuclei present per square centimeter of the surface of the coating (i.e., spangle density) was not less than 100. This reveals that the present invention makes it possible to obtain a hot-dip aluminized steel sheet which includes a coating having a surface on which fine spangles are stably and sufficiently formed and which has a beautiful surface appearance due to the fine spangles thus formed on the surface of the coating. Furthermore, provided that the sum of the average Ti concentration and the average V concentration of the coating is not more than 0.03 mass %, an increase in the average B concentration tends to cause an increase in effective B concentration and in turn cause an increase in the spangle density. Thus, by controlling the average B concentration of the coating, it becomes easy to control the spangle density and it is possible to reduce spangle size to a greater extent.

It is inferred that the reason why Sample No. 11 and Sample No. 16 had a white rusted area of 5% or greater in SST test is that the K concentration of the coating is high.

On the other hand, Samples No. 19 and No. 21, which are comparative examples, did not achieve a spangle-size-reducing effect, because, although the sum of the Ti concentration and the V concentration is not more than 0.03 mass %, the B concentration is less than 0.005 mass %.

Samples No. 20 and No. 22, which are comparative examples, did not achieve a spangle-size-reducing effect, because the sum of the Ti concentration and the V concentration is more than 0.03 mass % and the B concentration is less than 0.005 mass %. Samples No. 23 to No. 30, which are comparative examples, did not achieve a spangle-size-reducing effect because, although the B concentration is not less than 0.005 mass %, the sum of the Ti concentration and the V concentration is more than 0.03 mass %.

Note that, as is clear from Samples No. 1 to No. 30 shown in Table 4, the average concentration of Si contained in the coating does not particularly affect the effect of the present invention.

Embodiment 2

The following description will discuss another embodiment of the present invention. For convenience of description, members having functions identical to those of Embodiment 1 are assigned identical referential numerals and their descriptions are omitted.

Embodiment 1 discussed an arrangement in which an Al-based hot-dip coating bath 3, whose B, Ti and V concentrations fall within certain ranges, is prepared using an Al metal with reduced amounts of Ti and V. Generally, it is costly to produce such an Al metal and thus such an Al metal is more expensive than a low-grade Al metal. Embodiment 2 will discuss a hot-dip aluminized steel sheet in accordance with one aspect of the present invention produced using a low-grade Al metal and a method of producing such a hot-dip aluminized steel sheet.

Hot-Dip Aluminized Steel Sheet

The inventors conducted studies on the basis of the foregoing findings, and found that a hot-dip aluminized steel sheet with very fine spangles (spangle density is not less than 500 spangles/$cm^2$) can be obtained when the following condition is satisfied.

Specifically, the hot-dip aluminized steel sheet in accordance with Embodiment 2 satisfies the following condition (1):

$$[B] \geq 0.017+0.45\times[Ti]+0.42\times[V] \quad (1)$$

where [B] represents the average B concentration (in mass %) of an Al-based coating of the hot-dip aluminized steel sheet, [Ti] represents the average Ti concentration (in mass %) of the Al-based coating, and [V] represents the average V concentration (in mass %) of the Al-based coating.

The Ti and V in the coating bath react with B in the coating bath to form $TiB_2$ and $VB_2$, respectively, because of their thermodynamic stability. The mass ratio (atomic ratio) of B to V in $TiB_2$ is 0.45, and the mass ratio (atomic ratio) of Ti to V in $VB_2$ is 0.42. Therefore, the amount of B consumed by Ti and V is equal to 0.45×[Ti]+0.42×[V].

Method of Producing Hot-Dip Aluminized Steel Sheet

The following description will discuss a method of producing a hot-dip aluminized steel sheet in accordance with Embodiment 2.

The method of producing a hot-dip aluminized steel sheet in accordance with

Embodiment 2 includes: a coating bath preparing step including preparing an Al-based hot-dip coating bath containing aluminum as a main component such that the Al-based hot-dip coating bath satisfies the following condition (1):

$$[B] \geq 0.017+0.45\times[Ti]+0.42\times[V] \quad (1)$$

where [B] represents the B concentration (in mass %) of the Al-based hot-dip coating bath, [Ti] represents the Ti concentration (in mass %) of the Al-based hot-dip coating bath, and [V] represents the V concentration (in mass %) of the Al-based hot-dip coating bath; and a coating step including dipping a substrate steel sheet in the Al-based hot-dip coating bath thus prepared and passing the substrate steel sheet through the Al-based hot-dip coating bath.

Coating Bath Preparing Step

In the same manner as described in Embodiment 1 with reference to FIG. 3, an aluminum ingot(s) and additive substances are allowed to melt in a pre-melting pot 6, and thereby a composition-adjusted coating bath 3*a* for supply to an aluminum pot 4 is prepared.

In Embodiment 2, a low-grade Al metal is allowed to melt in the pre-melting pot 6 into molten Al. The low-grade Al metal is, for example, an Al metal obtained by primary smelting of bauxite via a Bayer process and a Hall-Heroult process. The low-grade Al metal may be some other Al metal obtained by primary smelting via some other method.

Based on the Ti concentration and the V concentration of the molten Al prepared using the low-grade Al metal, a certain amount or more of a B source is added such that the foregoing condition (1) is satisfied, and thereby the composition-adjusted coating bath 3*a* for supply to the aluminum pot 4 is prepared.

Next, the composition-adjusted coating bath 3*a* is transferred to the aluminum pot 4, where the Al-based hot-dip coating bath 3 whose B content falls within the range defined in the present invention is made.

Alternatively, the Al-based hot-dip coating bath 3, whose B concentration falls within the range defined in the present invention, may be made by adjusting the composition of the coating bath within the aluminum pot 4 without using the pre-melting pot 6. Alternatively, the composition-controlled coating bath 3*a* prepared with the use of the pre-melting pot 6 may be cooled to solid form (ingot) and then the ingot may be transferred into the aluminum pot 4.

Alternatively, a mixture of a low-grade Al metal and a high-purity Al metal may be used to make the Al-based hot-dip coating bath 3.

Coating Step

In the coating step, in the same manner as described in Embodiment 1 with reference to FIG. 3, a substrate steel sheet 1 is dipped in and passed through the Al-based hot-dip coating bath 3. Then, a general post treatment (not illustrated) is carried out. This makes it possible to continuously produce a hot-dip aluminized steel sheet having fine spangles stably formed on the surface of its coating.

According to the above method, it is possible to produce a hot-dip aluminized steel sheet with very fine spangles with the use of a low-grade Al metal, which is more reasonable than a high-purity Al metal. This makes it possible to reduce the production cost of the hot-dip aluminized steel sheet.

EXAMPLE 2

The Following is an Example of Embodiment 2.

Cold-rolled annealed steel sheets 0.8 mm in thickness, each having the chemical composition shown in Table 1 in the foregoing Example 1, were used as substrate steel sheets, and hot-dip aluminized steel sheets (test samples) were prepared under the conditions shown in Table 2 in the foregoing Example 1.

The components of each coating bath were adjusted using aluminum metals A to F shown in Table 3 in the foregoing Example 1. The obtained hot-dip aluminized steel sheets were subjected to analyses in the same manner as described in the foregoing Example 1.

The results are shown in Table 5.

TABLE 5

| | | Amount of each element in coating (mass %) | | | | | | Spangle density (number of spangle crystal | Surface | Corrosion |
|---|---|---|---|---|---|---|---|---|---|---|
| Sample type | No. | Si | B | K | Ti | V | Ti + V | nuclei per $cm^2$) | appearance | resistance |
| Samples of | 31 | 0.5 | 0.031 | 0.0001 | 0.014 | 0.019 | 0.033 | 600 | Excellent | Good |
| Example of | 32 | 9.0 | 0.033 | <0.0001* | 0.018 | 0.014 | 0.032 | 1000 | Excellent | Good |
| the present | 33 | 5.0 | 0.034 | 0.0004 | 0.020 | 0.005 | 0.025 | 1500 | Excellent | Good |
| invention | 34 | 8.6 | 0.038 | 0.0006 | 0.011 | 0.022 | 0.033 | 2000 | Excellent | Good |
| | 35 | 12.1 | 0.050 | 0.0002 | 0.020 | 0.045 | 0.065 | 1200 | Excellent | Good |

TABLE 5-continued

| Sample type | No. | Amount of each element in coating (mass %) Si | B | K | Ti | V | Ti + V | Spangle density (number of spangle crystal nuclei per cm$^2$) | Surface appearance | Corrosion resistance |
|---|---|---|---|---|---|---|---|---|---|---|
| | 36 | 9.1 | 0.051 | 0.0009 | 0.020 | 0.020 | 0.040 | 2100 | Excellent | Good |
| | 37 | 9.0 | 0.042 | 0.0003 | 0.006 | 0.031 | 0.037 | 2000 | Excellent | Good |
| | 38 | 8.8 | 0.044 | 0.005 | 0.040 | 0.006 | 0.046 | 1000 | Excellent | Good |
| | 39 | 9.1 | 0.048 | 0.012 | 0.019 | 0.016 | 0.035 | 2400 | Excellent | Good |
| | 40 | 11.9 | 0.380 | <0.0001* | 0.080 | 0.090 | 0.170 | 2500 | Excellent | Good |
| | 41 | 8.7 | 0.420 | 0.008 | 0.049 | 0.053 | 0.102 | 2200 | Excellent | Good |
| Samples of comparative examples | 42 | 9.1 | <0.001* | <0.0001* | 0.001 | 0.002 | 0.003 | 5 | Very Poor | Good |
| | 43 | 9.0 | 0.002 | 0.0001 | 0.006 | 0.009 | 0.015 | 5 | Very Poor | Good |
| | 44 | 4.8 | 0.005 | 0.0001 | 0.001 | 0.001 | 0.002 | 5 | Very Poor | Good |
| | 45 | 0.5 | 0.008 | 0.0004 | 0.006 | 0.011 | 0.017 | 5 | Very Poor | Good |
| | 46 | 8.7 | 0.017 | 0.0004 | 0.006 | 0.019 | 0.025 | 50 | Poor | Good |
| | 47 | 8.8 | 0.028 | <0.0001* | 0.040 | 0.005 | 0.045 | 120 | Good | Good |
| | 48 | 9.0 | 0.031 | <0.0001* | 0.010 | 0.050 | 0.060 | 100 | Good | Good |
| | 49 | 12.0 | 0.042 | 0.001 | 0.001 | 0.100 | 0.101 | 5 | Poor | Good |
| | 50 | 14.6 | 0.050 | 0.020 | 0.100 | 0.005 | 0.105 | 50 | Poor | Good |

*B is not greater than the detectable limit by ICP-AES, K is not greater than the detectable limit by ICP-MS.

As is clear from Samples No. 31 to No. 41 shown in Table 5, when the proportions of components of the coating fall within the ranges defined in the present invention, the number of spangle crystal nuclei per square centimeter of the surface of the coating (spangle density) is 500 or more. This reveals that the present invention makes it possible to obtain a hot-dip aluminized steel sheet which has fine spangles stably and sufficiently formed on the surface of its coating and thus has a beautiful surface appearance. Meanwhile, as with the case with the foregoing Example 1, an increase in the average B concentration of the coating tends to cause an increase in the effective B concentration and in turn cause an increase in spangle density. Thus, by controlling the average B concentration of the coating, it becomes easy to control the spangle density and it becomes possible to reduce spangle size to a greater extent.

On the other hand, Samples No. 42 to No. 50 are comparative examples, and their B concentration of the coating does not satisfy the following condition:

$$[B] \geq 0.017+0.45\times[Ti]+0.42\times[V] \quad (1)$$

It follows that the spangle density is less than 500 per square centimeter. Note that Samples No. 11, No. 12, and No. 14 to No. 18 shown in Table 4 in the foregoing Example 1 also fall within the range of Example 2.

The present invention is not limited to the embodiments, but can be altered by a skilled person in the art within the scope of the claims. The present invention also encompasses, in its technical scope, any embodiment derived by combining technical means disclosed in differing embodiments.

REFERENCE SIGNS LIST

1 Substrate steel sheet
3 Al-based hot-dip coating bath
10 Spangle crystal nucleus
20 High-purity Al metal
30 B source

What is claimed:

1. A method of producing a hot-dip aluminized steel strip which has a coating having a surface on which a spangle pattern appears, the spangle pattern being formed due to dendrites, which are structures obtained by solidification of aluminum, comprising:

a coating bath preparing step including preparing an aluminum-based hot-dip coating bath containing aluminum as a main component such that the aluminum-based hot-dip coating bath satisfies the following condition (1):

$$[B] \geq 0.017+0.45\times[Ti]+0.42\times[V] \quad (1)$$

where [B] represents a boron concentration (in mass %) of the aluminum-based hot-dip coating bath, [Ti] represents a titanium concentration (in mass %) of the aluminum-based hot-dip coating bath, and [V] represents a vanadium concentration (in mass %) of the aluminum-based hot-dip coating bath; and a coating step including continuously dipping the substrate steel strip in the aluminum-based hot-dip coating bath thus prepared and continuously passing the substrate steel strip through the aluminum-based hot-dip coating bath, wherein the coating bath preparing step includes preparing the aluminum-based hot-dip coating bath by (i) melting a first aluminum metal containing more than 0.02 mass % in total of titanium and vanadium to produce an aluminum bath liquid and thereafter (ii) adding a second aluminum metal containing boron a boron source to the aluminum bath liquid, wherein the spangle pattern includes not less than 500 spangle crystal nuclei per square centimeter of an area of the surface of the coating.

* * * * *